United States Patent [19]

Hawryluk

[11] 4,036,914

[45] July 19, 1977

[54] LIQUID FUEL MIXING DEVICE

[76] Inventor: John Hawryluk, 601 Middlesex Drive, Cinnaminson, N.J. 08077

[21] Appl. No.: 604,712

[22] Filed: Aug. 14, 1975

[51] Int. Cl.[2] ..... F02M 29/06

[52] U.S. Cl. ..... 261/79 R; 261/119 R

[58] Field of Search ..... 261/79 R, 79 A, 119 R; 123/135, 133, 141; 261/DIG. 55, DIG. 21

[56] References Cited

U.S. PATENT DOCUMENTS

| | | | |
|---|---|---|---|
| 554,909 | 2/1896 | Clark | 261/119 R |
| 557,068 | 3/1896 | Gintz | 261/119 R |
| 1,756,805 | 4/1930 | Baker | 261/79 R |
| 1,797,978 | 3/1931 | Garrett | 261/DIG. 55 |
| 1,998,784 | 4/1935 | Mock | 123/141 |
| 2,473,672 | 6/1949 | Ziliotto | 261/79 A |
| 2,822,253 | 2/1958 | Caddock | 123/141 |
| 3,237,385 | 3/1966 | Nutting | 261/79 A |
| 3,667,221 | 6/1972 | Taylor | 261/79 R |
| 3,811,663 | 5/1974 | Sterlini | 261/79 A |

FOREIGN PATENT DOCUMENTS

| | | | |
|---|---|---|---|
| 477,204 | 5/1929 | Germany | 261/79 A |
| 370,487 | 4/1932 | United Kingdom | 261/79 R |

*Primary Examiner*—Tim R. Miles

*Attorney, Agent, or Firm*—Shlesinger, Arkwright, Garvey & Dinsmore

[57] ABSTRACT

A mixing cylinder mounted in an air stream is supplied with liquid fuel and has an opening into which part of the air stream enters and has a swirling motion imparted to it so that it mixes with the vapor from the liquid fuel disposed within the mixing cylinder and then returns to the air stream.

5 Claims, 6 Drawing Figures

LIQUID FUEL MIXING DEVICE

BACKGROUND OF THE INVENTION

Air-fuel mixing devices have grown increasingly complex and specialized in design to meet the needs of engine systems which use liquid fuel.

The requirement for varying amounts of an air-fuel mixture, different air mixture percentages, and large vehicle engines have all contributed to specialized carburetion devices, particularly in the automotive field.

There has been a need for a device of simple construction which effectively mixes both the air and fuel in an efficient manner.

SUMMARY OF THE INVENTION

Accordingly, this invention relates to carburetion devices of simple construction which provide for adequate mixing of the liquid fuel with a passing air stream.

This invention provides for a very efficient device for mixing of liquid fuel and air vapor for carburetion.

Excellent results are achieved with a simplified air-fuel mixing device in which incoming air is passed through a mixing chamber which imparts a continuous swirling motion to the incoming air from the air stream and passes it directly over the liquid fluid disposed at the bottom of the mixing chamber. This brings about thorough mixing of both air and fluid to provide a uniform air-fuel mixture without elaborate and complex apparatus.

DESCRIPTION OF THE INVENTION

Referring particularly to the drawings, 10 is an air conduit of circular cross section having the mixing chamber cylinder 12, disposed therein. Air enters the mixing cylinder interior 14 through the control air intake.

Figure 1:
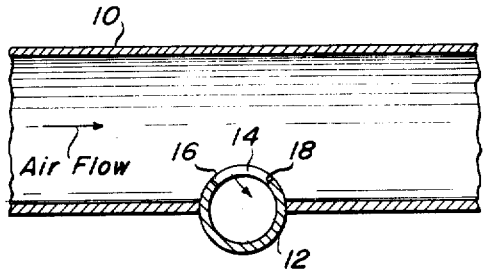
FIG. 1 shows a cross-sectional view of the air mixing device.
Figure 2:
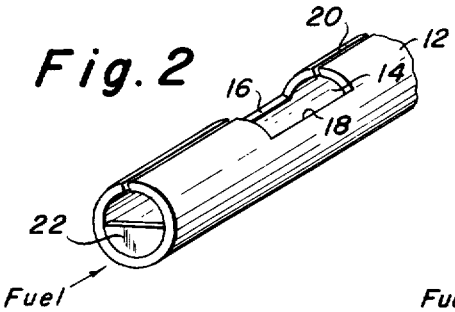
FIG. 2 is s perspective view of the mixing chamber of FIG. 1.
Figure 3:
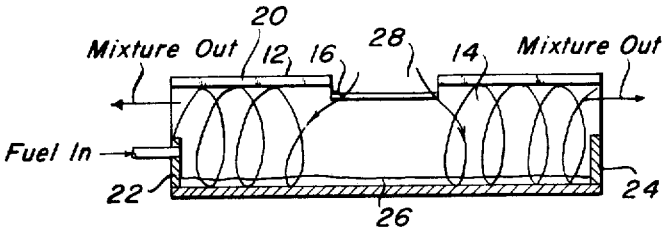
FIG. 3 is a longitudinal cross section of the mixing chamber showing the direction of air flow through it.

In FIG. 2 a larger view of the mixing cylinder 12 is shown. It will be noted that it is a hollow cylindrical piece having the central air intake section defined by the edges 16 and 18 and an elongated thin slot 20 extending the length of the unit.

Figure 5:
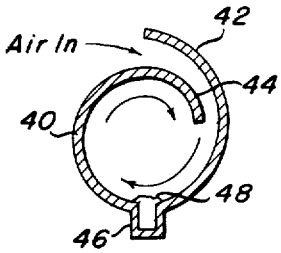
FIG. 5 is a cross-sectional view of a third type of mixing chamber which has special provision for imparting circular air movement.

The cross-sectional view in FIG. 5 shows the manner in which the air and fuel are intermixed. The mixing cylinder 12 has its open ends partially closed at the lower section thereof at 22 and 24 to contain a small amount of fluid 26 supplied to the cylinder from either side. Air is supplied, as shown in 28, through the central intake opening defined by the cut-out sections 16 and 18. A rotational, swirling motion is imparted to it as it strikes the mixing cylinder interior surface 14 where it intermixes with the vapors of the fluid body 26 and moves outwardly to either end of the mixing cylinder to return to the air stream passing around the mixing cylinder.

Figure 4:
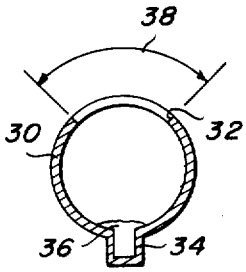
FIG. 4 is a cross-sectional view of a second type of mixing chamber which provides a reservoir for the liquid fuel.

A cross-sectional view of another type mixing chamber 30 is shown in FIG. 4. The central air stream air intake is shown at 32. An elongated well 34 is disposed at the bottom of the mixing cylinder 30 and extends the length thereof. It contains liquid fuel as shown at 36. The size of the central air intake opening 32 is important. The central angle must be of a minimum of 30° and, as shown in FIG. 4, it can be as large as 90°, depending upon the velocity of the air stream passing over the opening.

FIG. 5 shows another modification 40 of the mixing cylinder design, wherein swirling motion is imparted by the design of the intake opening itself. In this instance the walls 42 and 44 overlap and, inasmuch as the opening between them directly faces the air stream, a large volume of air directly strikes the walls and has circular motion imparted to it as it passes to the interior of the mixing chamber. The circularly moving air stream passes over the liquid fuel chamber 46 containing the liquid fuel 48 to pick up liquid vapor.

Figure 6:
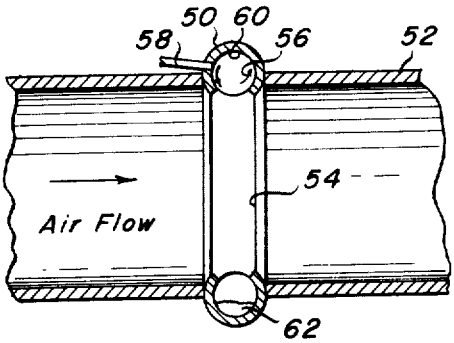
FIG. 6 is a cross-sectional view of another type of air mixing device using a toroidal shaped mixing chamber.

Another modification of mixing chamber design is as shown in FIG. 6 in which the mixing chamber 50 has an annular configuration and has a diameter sightly less than that of the air conduit 52. Air is receieved through a slotted opening 54 which extends around the entire inner periphery of the mixing chamber 50. Part of the air stream enters the air intake opening 54 and has a swirling, circular motion imparted to it, as indicated by the arrows 56. Liquid fuel is supplied through the duct 58 and flows down the inner wall 60, mixing with the incoming air to the mixing chamber 50 as it descends to the bottom of the chamber where unevaporated liquid fuel is accumulated in the pool 62. Air fuel mixture leaves the mixing chamber through the opening 54 through which fresh air is also supplied.

It should be noted that the size of the air intake opening is dependent upon the velocity of the air stream passing over the mixing chamber. A 30 ° cut in the mixing chamber is required, and a minimum is linear velocity of three fee per second for the passing air stream is also required.

With respect to the width of the air intake opening shown in FIGS. 1 through 4, it has been found that the length of the opening is preferably about one-third the overall length of the mixing cylinder.

While this invention has been described, it will be understood that it is capable of further modification, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention and the limits of the appendend claims.

What I claim is:

1. A fuel-air mixing device, comprising:

a. an elongated conduit through which air is passed and which has a horizontal section, b. a hollow fuel-air mixing chamber disposed transversely across the horizontal section of the conduit, c. the mixing chamber extending only slightly into the conduit such that it blocks substantially less than half the cross-sectional area thereof, and having a liquid fuel retaining section in its lower portion, d. the surface of the mixing chamber in the conduit having a relatively wide central opening disposed transversely to the conduit and through which a portion of the air stream in the conduit passes, e. the inner wall of the mixing chamber having a generally circular configuration which imparts a circular swirling motion to the air stream passing through the central opening so that it contacts the surface of the fuel in the liquid fuel retaining section.

2. The fuel-air mixing device as set forth in claim 1, wherein:

a. the opening in the mixing chamber extends for approximately one-third the length thereof and subtends an angle of from 30° to 90°.

3. The fuel-air mixing device as set forth in claim 1, wherein:

a. the opening in the mixing device chamber is formed by two spaced overlapping edges between which a portion of the passing air stream is received.

4. The fuel-air mixing device as set forth in claim 1, wherein:

a. the mixing chamber is of a toroidal shape.

5. The fuel-air mixing device as set forth in claim 4, wherein:

a. the air intake extends the length of the mixing device, b. the liquid fuel supply means is connected to the mixing chamber inner wall adjacent the top thereof.

* * * * *